US008069930B2

(12) United States Patent
Engelfried

(10) Patent No.: US 8,069,930 B2
(45) Date of Patent: Dec. 6, 2011

(54) HAND POWER TOOL WITH VIBRATION-DAMPED PISTOL GRIP

(75) Inventor: Uwe Engelfried, Ostfildern (DE)

(73) Assignee: Robert Bosch GmbH, Stuttgart (DE)

( * ) Notice: Subject to any disclaimer, the term of this patent is extended or adjusted under 35 U.S.C. 154(b) by 960 days.

(21) Appl. No.: 11/242,345

(22) Filed: Oct. 3, 2005

(65) Prior Publication Data

US 2006/0086515 A1 Apr. 27, 2006

(30) Foreign Application Priority Data

Oct. 22, 2004 (DE) ..... 10 2004 051 465

(51) Int. Cl.
*B25D 17/24* (2006.01)

(52) U.S. Cl. ..... 173/162.2; 173/162.1

(58) Field of Classification Search ..... 173/162.2, 173/162.1; 16/430, 431
See application file for complete search history.

(56) References Cited

U.S. PATENT DOCUMENTS

| | | | | |
|---|---|---|---|---|
| 4,667,749 | A * | 5/1987 | Keller | 173/162.2 |
| 4,921,053 | A * | 5/1990 | Dobry et al. | 173/162.2 |
| 5,692,574 | A * | 12/1997 | Terada | 173/162.2 |
| 5,697,456 | A | 12/1997 | Radle et al. | |
| 6,076,616 | A * | 6/2000 | Kramp et al. | 173/162.2 |
| 6,148,930 | A * | 11/2000 | Berger et al. | 173/162.2 |
| 2003/0037937 | A1 * | 2/2003 | Frauhammer et al. | 173/48 |
| 2003/0132016 | A1 | 7/2003 | Meixner et al. | |
| 2004/0040729 | A1 * | 3/2004 | Meixner | 173/162.2 |
| 2005/0247464 | A1 * | 11/2005 | Hellbach et al. | 173/162.2 |

FOREIGN PATENT DOCUMENTS

| | | |
|---|---|---|
| DE | 40 00 861 A1 | 7/1991 |
| DE | 100 36 078 | 2/2002 |
| EP | 1 533 084 | 5/2005 |
| EP | 1 602 450 | 12/2005 |

* cited by examiner

*Primary Examiner* — Lindsay Low

(74) *Attorney, Agent, or Firm* — Michael J. Striker

(57) ABSTRACT

A hand power tool, in particular a drill hammer, percussion drill or percussion screwdriver, includes a pistol grip (2), which is connected in vibration-damped fashion to the tool housing (1). The pistol grip (2) is supported on the tool housing (1) pivotably about a shaft (5), and the shaft (5) extends transversely to the primary direction of vibration (3) of the hand power tool. At least one spring element (10), which acts in the direction of vibration, is located between the tool housing (1) and the pistol grip (2).

11 Claims, 2 Drawing Sheets

Fig. 2
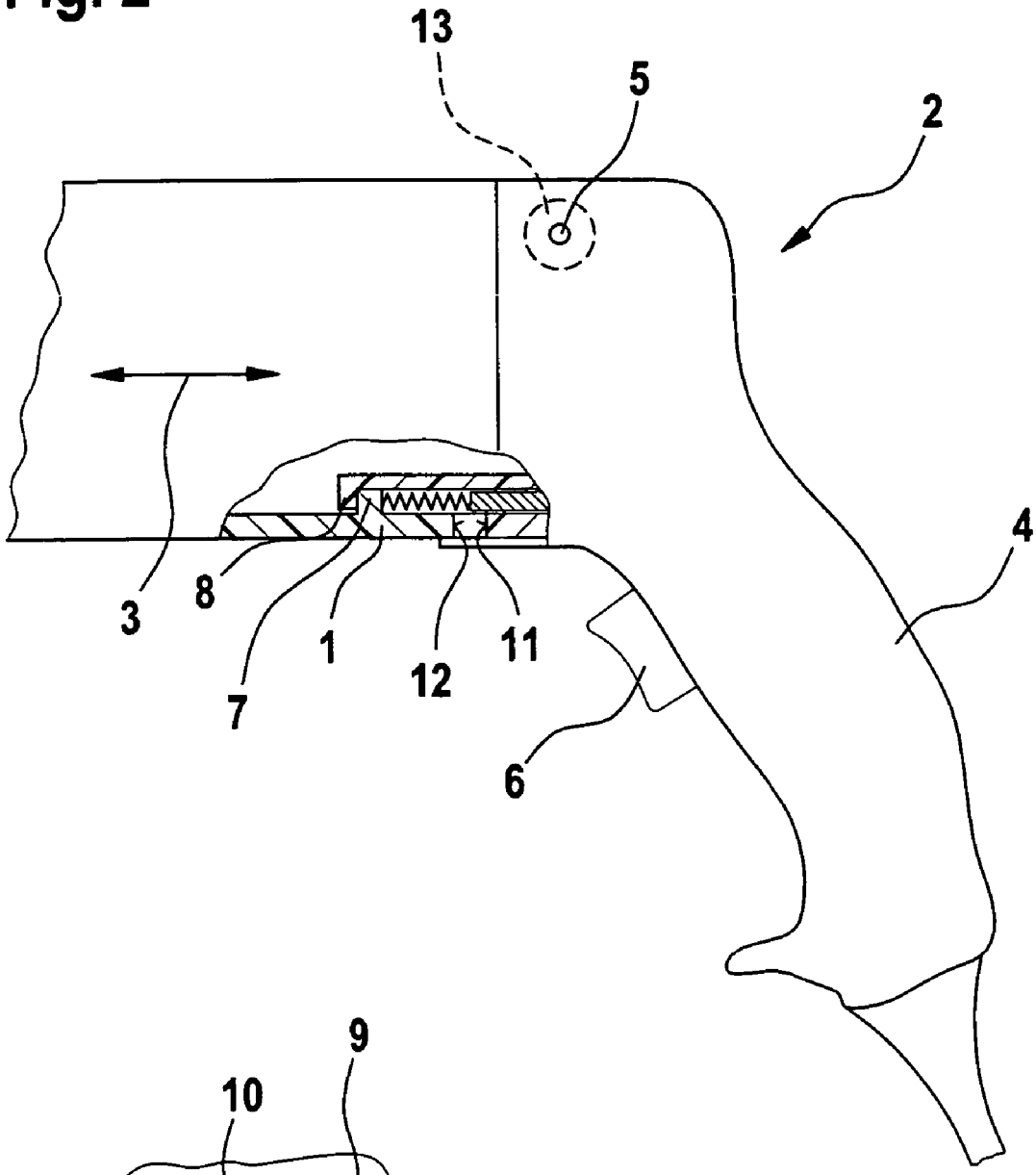
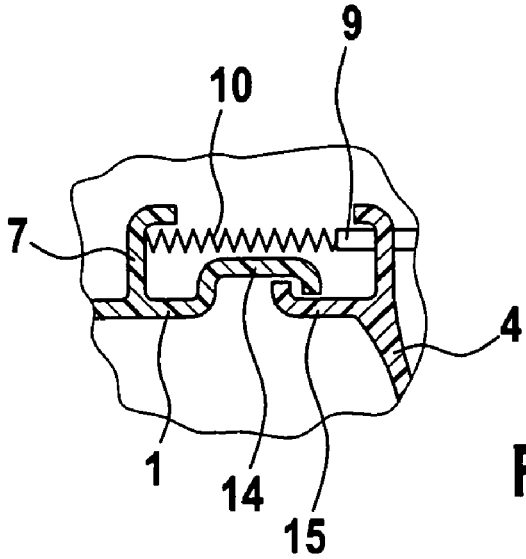
Fig. 3

HAND POWER TOOL WITH VIBRATION-DAMPED PISTOL GRIP

BACKGROUND OF THE INVENTION

The present invention relates to a hand power tool, in particular a drill hammer, percussion drill or percussion screwdriver, having a pistol grip that is connected to the tool housing in a vibration-damped manner.

Particularly in hand power tools that have a percussion mechanism, such as drill hammers, percussion drills or percussion screwdrivers, very major vibration of the tool housing occurs, which is transmitted to the grip and from there undamped to the hands or arms of the users, unless some of sort of vibration-damping means are provided. In German Patent DE 40 00 861 C3, the pistol grip of a hand power tool is joined to the tool housing in a vibration-damped manner in such a way that an envelope housing, solidly joined to the pistol grip, surrounds the tool housing, and this envelope housing is decoupled from the tool housing by means of rubber-elastic bodies.

SUMMARY OF THE INVENTION

The object of the invention is to provide a hand power tool in which the pistol grip is joined to the tool housing in a vibration-damped manner.

In keeping with these objects and with others which will become apparent hereinafter, one feature of the present invention resides, briefly stated, in a hand power tool in which the pistol grip is supported on the tool housing pivotably about a shaft, and the shaft extends transversely to the primary direction of vibration of the hand power tool, and at least one spring element acting in the vibration direction is located between the tool housing and the pistol grip. The vibration-damping provisions are implemented here by very simple technical means.

In accordance with one feature of the present invention, either the pivot shaft is located in the lower region of the tool housing, that is, in a portion of the pistol grip near the grip region, or the pivot shaft is located in the upper region of the tool housing, that is, in a portion of the pistol grip remote from the grip region.

In accordance with a further feature of the present invention, the at least one spring element may for instance comprise a tension or compression spring and/or an elastic body.

Advantageously, in accordance with the present invention a means is provided with which the prestressing of the at least one spring element is adjustable.

A further vibration-damping effect can be attained in accordance with the present invention by providing that the pivot shaft is elastically supported.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 2 shows a detail of a hand power tool with a pistol grip that is joined pivotably to the upper region of the tool housing via a pivot shaft; and FIG. 3 shows a variant for the resilient supporting of the pistol grip on the tool housing.

DESCRIPTION OF THE PREFERRED EMBODIMENTS

Figure 1:
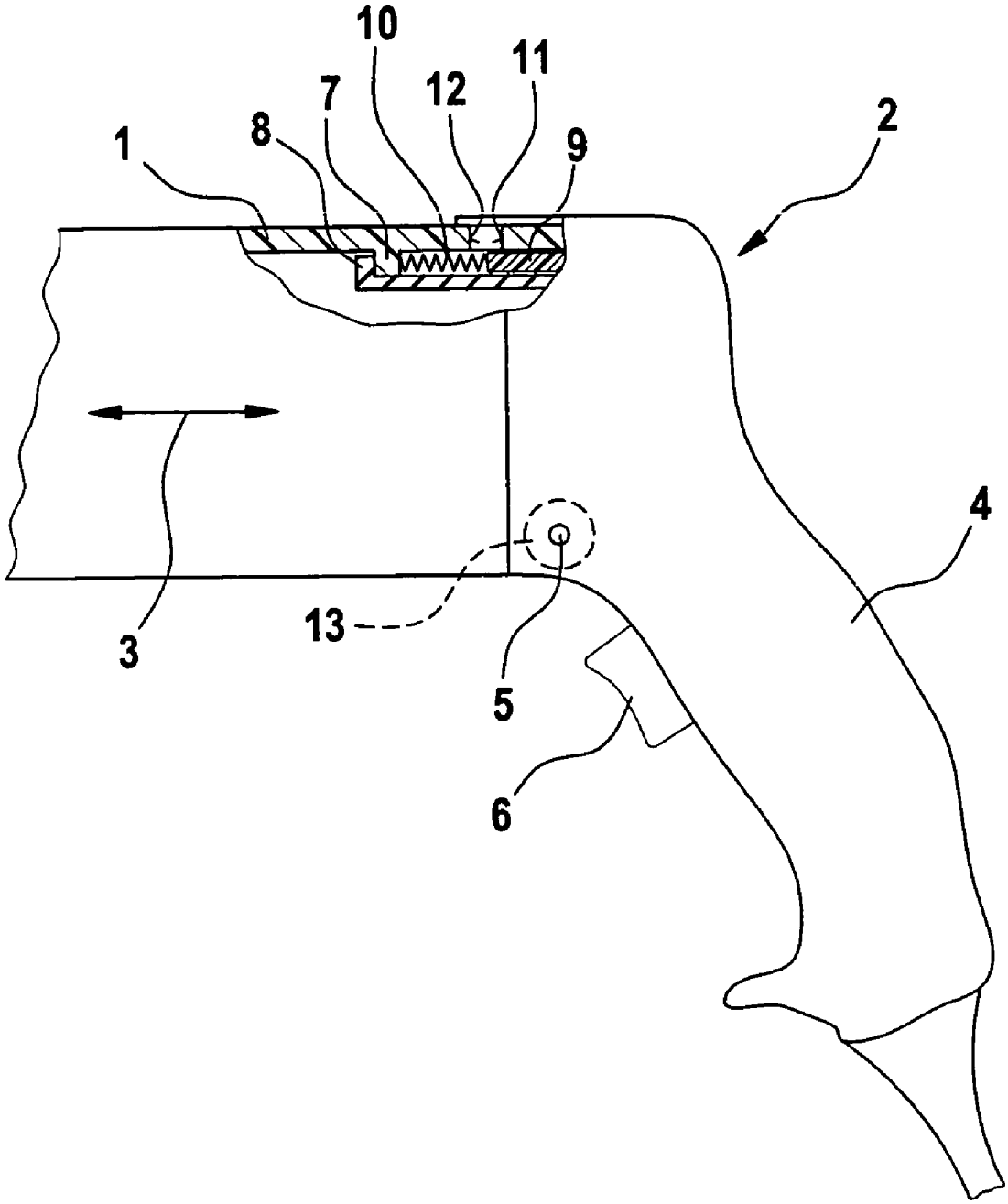
FIG. 1 shows a detail of a hand power tool with a pistol grip that is joined to the lower region of the tool housing via a pivot shaft.

FIG. 1 shows a detail of a hand power tool, which is for example a drill hammer or a percussion drill or a percussion screwdriver. A pistol grip 2 is joined to the tool housing 1 of the hand power tool. A motor, a gear and a percussion mechanism are typically located in the tool housing 1, in order to put the tool (such as a drill or chisel) into a rotary motion and/or an axial percussion motion. As a result of the axial percussion motion, the tool housing 1 experiences an axial vibration, represented by the arrow 3. The primary direction of vibration is accordingly the direction of the longitudinal axis of the tool.

When the pistol grip 2 is rigidly joined to the tool housing 1, the vibration of the tool housing 1 is transmitted undamped to the pistol grip 2. This is precisely to be avoided, for the sake of protecting the user. The provisions described below are therefore taken, in order to couple the pistol grip 2 to the tool housing 1 in a way that is as extensively vibration-damped as possible.

In the exemplary embodiment shown in FIG. 1, the pistol grip 2 is joined to a tool housing 1 in the lower region of the tool housing 1, that is, in the vicinity of the grip region 4, which has a switch 6, of the pistol grip 2, via a pivot shaft 5. The pivot shaft 5 is located transversely to the primary direction of vibration 3, so that the grip 2 can execute a pivoting motion about the shaft 5 relative to the tool housing 1.

On its end diametrically opposed to the pivot shaft 5, the pistol grip 2 is resiliently supported on the tool housing 1. This resilient support has the effect that between the tool housing 1 and the upper part of the pistol grip 2, there is a play of motion essentially in the primary direction of vibration 3. The resilient support of the upper part of the pistol grip 2 on the tool housing 1 can be embodied for instance as shown in FIG. 1. A radially inward-extending collar 7 is formed onto the tool housing 1, and a collar 8 that extends radially outward is likewise formed onto the pistol grip 2. The collar 8 on the pistol grip 2 engages the tool housing 1 behind the collar 7.

Also located on the pistol grip 2 is a stop bolt 9, which is set back in the direction of the pistol grip 2 relative to the two collars 7 and 8. A spring element 10 is inserted into the space between the two collars 7 and 8 and the stop bolt 9 and is braced on one end on the collar 7 of the tool housing 1 and on the other on the stop bolt 9 and thus presses the pistol grip 2 away from the tool housing 1.

The spring element 10 may be a compression spring or an elastic body (for instance of rubber or elastomer). Instead of a single spring element 10, a plurality of spring elements may be provided. A combination of a compression spring and an elastic body may also be employed. The resilient coupling between the pistol grip 2 and the tool housing 1 may also be implemented via one or more tension spring elements, depending on how the coupling between the tool housing 1 and the pistol grip 2 is designed.

The resilient motion of the pistol grip 2 back and forth relative to the tool housing 1 in the primary direction of vibration 3 is limited on one side by the two collars 7 and 8, which abut one another, and on the other by a stop 11 on the pistol grip, which meets a stop 12 on the tool housing 1. The spacing between the two stops 11 and 12 defines the play of motion between the pistol grip 2 and the tool housing 1.

It is advantageous if the stop bolt 9 is adjustable in the axial direction, so that the prestressing of the spring element 10 can be adjusted. With the prestressing of the spring element 10, the damping of the vibration transmitted from the tool housing 1 to the pistol grip 2 can be varied. The above-described resilient coupling between the tool housing 1 and the pistol grip 2 represents one possible embodiment.

An embodiment of the resilient support between the pistol grip 4 and the tool housing 1 that is modified compared to FIGS. 1 and 2 is shown in FIG. 3. Here the axial motion of the pistol grip 4 relative to the tool housing 1 is limited by the fact that an indentation 14 is formed onto the tool housing 1, and this indentation is engaged by a hooklike arm 15 of the pistol grip 4. The indentation 14 forms a front and a rear stop for the hooklike arm 15, and as a result the relative motion between the pistol grip 4 and the tool housing 1 is restricted.

An elastic support of the pivot shaft 5 can also contribute to additional vibration damping. The elastic support of the pivot shaft 5 can be implemented by locating this shaft in an elastic bush (for instance of rubber or elastomer) 13, which is located in the tool housing 1.

In the exemplary embodiment of FIG. 1, the pivot shaft 5 is located in the lower region of the tool housing and of the pistol grip 2 in the vicinity of the grip region 4 of the pistol grip 2, and the spring element 10, viewed transversely to the primary direction of vibration 3, is located on the upper end of the pistol grip 2.

As the exemplary embodiment shown in FIG. 2 shows, the sides for the pivot shaft 5 and the spring element 10 can also be transposed, so that the pivot shaft 5 is then located in the upper region of the tool housing 1 and of the pistol grip 2, and the spring element 10 is located in the lower region of the tool housing 1, in the vicinity of the grip region 4 of the pistol grip 2.

It will be understood that each of the elements described above, or two or more together, may also find a useful application in other types of constructions differing from the types described above.

While the invention has been illustrated and described as embodied in a hand power tool with vibration-damped pistol grip, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the invention.

The invention claimed is:

1. A hand power tool, comprising a tool housing; a pivot shaft extending transversely to a primary direction of vibration of the hand power tool; a pistol grip connected in vibration-damped fashion to said tool housing and supported on said tool housing pivotally about said pivot shaft; and at least one spring element acting in a direction of vibration of the hand power tool and located between said tool housing and said pistol grip, wherein said pistol grip has exclusively one connecting portion for coupling the pistol grip with the tool housing, wherein the connection portion comprises exclusively one continuously closed interface area lying inside the tool housing, and one end portion, wherein said end portion is spaced freely from the tool housing.

2. A hand power tool as defined in claim 1, wherein said pivot shaft is located in a lower region of said tool housing and in a portion of said pistol grip which is near a grip region.

3. A hand power tool as defined in claim 1, wherein said pivot shaft is located in an upper region of said tool housing and in a portion of said pistol grip which is remote from said grip region.

4. A hand power tool as defined in claim 1, wherein said at least one spring element is an element selected from the group consisting of a tension spring, a compression spring, and an elastic body.

5. A hand power tool as defined in claim 1, further comprising means for adjusting a prestressing of said at least one spring element.

6. A hand power tool as defined in claim 1, wherein said pivot shaft is elastically supported.

7. A hand power tool as defined in claim 1, wherein the hand power tool is a tool selected from the group consisting of a drill hammer, a percussion drill, and a percussion screwdriver.

8. A hand power tool as defined in claim 1, wherein said pivot shaft is arranged at the connection portion of the pistol grip and the pivot shaft is arranged distanced from the end portion of the pistol grip.

9. A hand power tool as defined in claim 1, wherein said end portion of the pistol grip comprises the grip region.

10. A hand power tool as defined in claim 1, wherein said pistol grip comprises a housing covering at least partially the tool housing.

11. A hand power tool as defined in claim 1, wherein said tool housing has a radial inward-extending collar and said pistol grip has a radial outward-extending collar, wherein said radial outward-extending collar engages the tool housing behind the radial inward-extending collar.

* * * * *